US006525451B1

(12) United States Patent
Hishinuma et al.

(10) Patent No.: US 6,525,451 B1
(45) Date of Patent: Feb. 25, 2003

(54) DIELECTRIC BARRIER DISCHARGE LAMP WITH TUBE REMNANT DISCHARGE CHAMBER CONNECTION

(75) Inventors: Nobuyuki Hishinuma, Himeji (JP); Kunio Kasagi, Himeji (JP); Masahide Kiyose, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 215 days.

(21) Appl. No.: 09/610,570

(22) Filed: Jul. 5, 2000

(30) Foreign Application Priority Data

Jul. 5, 1999 (JP) ..... 11-190188

(51) Int. Cl.[7] ..... H01J 11/00

(52) U.S. Cl. ..... 313/234; 313/493; 313/634; 313/635; 313/607

(58) Field of Search ..... 313/493, 634, 313/635, 607, 234; 315/248

(56) References Cited

U.S. PATENT DOCUMENTS 5,581,152 A * 12/1996 Matsuno et al. ..... 313/634
5,666,026 A * 9/1997 Matsuno et al. ..... 313/634
5,763,999 A * 6/1998 Matsuno et al. ..... 313/573
5,911,613 A * 6/1999 Byrum et al. ..... 445/6
6,084,360 A * 7/2000 Yokokawa et al. ..... 315/287

OTHER PUBLICATIONS

Discharge Handbook, Denki Gakkai, Rev. Ed. Jun. 1989, pp. 263–273 no translation.

* cited by examiner

*Primary Examiner*—Ashok Patel
*Assistant Examiner*—Glenn D. Zimmerman
(74) *Attorney, Agent, or Firm*—Nixon Peabody LLP; David S. Safran

(57) ABSTRACT

To enable the easy and adequately reliable cleaning of the inner surface of the chamber material, and as a result, to provide a dielectric barrier discharge lamp with good lighting characteristics and simplicity of manufacture, a dielectric barrier discharge lamp having a discharge chamber with a cylindrical, double-tube construction with an outer tube and an inner tube, in which the cylindrical discharge space formed between the outer tube and the inner tube is filled with a discharge gas in which excimer molecules are formed by a dielectric barrier discharge, two or more fluid distribution tube remnants connecting to each discharge chamber. It is preferable that the dielectric barrier discharge lamp described above have two or more fluid distribution tube remnants formed on opposite ends of the discharge chamber.

2 Claims, 4 Drawing Sheets

DIELECTRIC BARRIER DISCHARGE LAMP WITH TUBE REMNANT DISCHARGE CHAMBER CONNECTION

BACKGROUND OF THE INVENTION

1. Field of the Invention

This invention concerns dielectric barrier discharge lamps that use dielectric barrier discharges to emit excimer light.

2. Description of Related Art

Recent years have seen the development and practical application of surface treatment technology in which metals, glass and other materials are irradiated with vacuum ultraviolet light at wavelengths of 200 nm or less, in which the action of the vacuum ultraviolet light irradiation heat treatment equipment and the ozone produced thereby affect the material being treated, including cleaning treatment technology that removes organic pollutants adhered to the surface of the material being treated, and oxide film formation technology that forms an oxide film on the surface of the material being treated.

The lamps used to conduct this sort of ultraviolet treatment have been dielectric barrier discharge lamps that have a discharge chamber made of a dielectric and filled with an appropriate gas for excimer light, in which a dielectric barrier discharge (also called an "ozonizer discharge" or "silent discharge"—see Denki Gakkai: "Discharge Handbook,"rev. ed. June 1989, p 263) in the discharge chamber produces excimers and causes the emission of excimer light.

An example of a method of producing such a dielectric barrier discharge lamp is described below. FIG. 7 is an explanatory cross-section showing an example of the structure of the chamber material to form the discharge chamber in a conventional dielectric barrier discharge lamp. In this figure, 40A is chamber material to form the discharge chamber of the dielectric barrier discharge lamp. It has a two-layer structure comprising a cylindrical outer tube 41 and an inner tube 42 made of quartz glass, which is a dielectric. The two ends of the outer tube 41 and the inner tube 42 are joined by end walls 43, 44, and the space between the outer tube 41 and the inner tube 42 forms a toroidal internal space R. Additionally, an exhaust tube 45 is attached to the end wall 43 so as to connect to the internal space R.

Before the internal space R is filled with a discharge gas, the interior of this chamber material 40A is cleaned, perhaps by inserting a needle 46A of a syringe 46 into the exhaust tube 45, as shown in FIG. 8, and injecting a cleaning reagent, such as an aqueous solution of ammonium fluoride, for example, into the chamber material 40A. Then, after the interior surface of the chamber material 40A has been cleaned, the cleaning reagent is shaken out of the chamber material 40A. After that, the chamber material 40A is rinsed with water to wash out any remaining cleaning reagent; the rinse water is injected and removed in the same way as the cleaning reagent was.

After the chamber material 40A with its clean inner surface is dried, the exhaust tube 45 is connected to exhaust equipment, the air in the internal space R is exhausted, and the internal space R is filled with the discharge gas. Then, as shown in FIG. 9, the exhaust tube 45 is burned off and the internal space R is sealed by means of a burner, for example, producing a lamp proper 50 that has discharge gas sealed into the discharge chamber 40 with an exhaust tube remnant 47.

The dielectric barrier discharge lamp is produced by using appropriate means to attach an electrode to the outer surface of the outer tube 41 of the lamp proper 50, and another electrode to the inner surface of the inner tube 42.

Nevertheless, there are the following problems when dielectric barrier discharge lamps are manufactured by the method described above. It is difficult to perform, with high work efficiency, the operations of injecting and removing the cleaning fluids into and out of the chamber material 40A through the exhaust tube 45 attached to the chamber material 40A. As a result, the manufacture of dielectric barrier discharge lamps requires a long time.

Moreover, because it is difficult to perform the operations of injecting and removing the cleaning fluids into and out off the chamber material 40A, there are times when the inner surface of the chamber material 40A cannot be cleaned adequately, and dirt or foreign objects remain inside the chamber material 40A. As a result, when a dielectric barrier discharge lamp is manufactured using that chamber material 40A, good discharges in that dielectric barrier discharge lamp will be obstructed, the lighting intensity will drop, and a lighting flaw will occur.

SUMMARY OF THE INVENTION

This invention is based on the situation described above, and has a primary object of providing a dielectric barrier discharge lamp of which the inner surface of the chamber material can be cleaned easily and reliably, which consequently has good lighting characteristics, and which is easy to manufacture.

This object is achieved by the invention by a dielectric barrier discharge lamp having a discharger chamber with a cylindrical, double-tube construction comprising an outer tube and an inner tube, in which the cylindrical discharge space formed between the outer tube and the inner tube is filled with a discharge gas in which excimer molecules are formed by a dielectric barrier discharge, and in the discharge chamber is formed with at least two fluid distribution tube remnants that connect to each discharge chamber.

It is preferable that the dielectric barrier discharge lamp described above have two or more fluid distribution tube remnants formed on opposite ends of the discharge chamber.

In the manufacture of the dielectric barrier discharge lamp constituted as described above, there are two or more fluid distribution tubes on the chamber material that makes up the discharge chamber, and so it will be possible, while using at least one fluid distribution tube as a route for injection or removal of cleaning fluids, to secure the other fluid distribution tube as a route for air in the chamber material to be discharged, and so the action of injecting cleaning fluids into the chamber material and the action of removing them can be performed easily and reliably. As a result, it is possible to clean and remove dirt and foreign objects from the inner surface of the chamber material. Thus, it is possible to prevent drops in lighting intensity and the occurrence of lighting flaws that originate from dirt or foreign objects on the inner surface of the chamber material, and so it is possible to obtain good lighting characteristics.

DETAILED DESCRIPTION OF THE INVENTION

Figure 1:
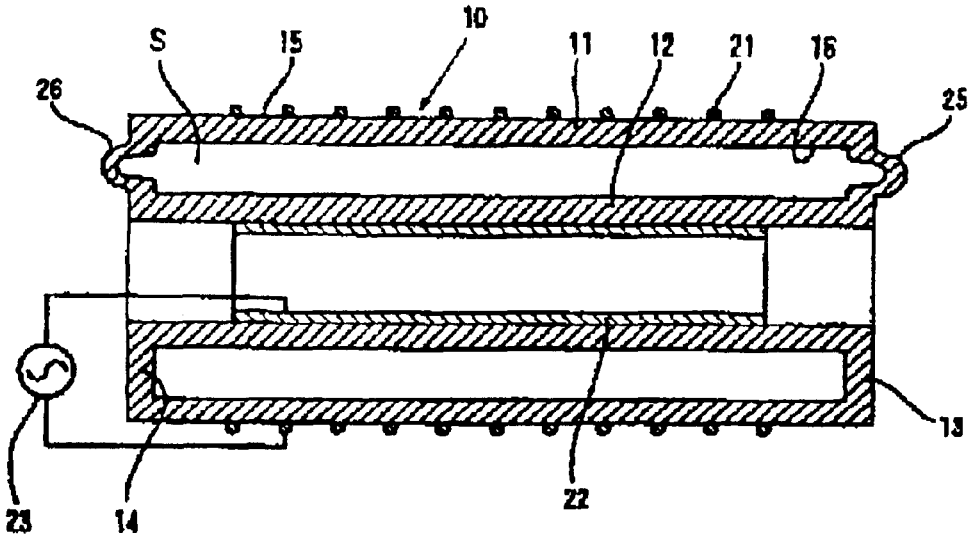
FIG. 1 is sectional view of one example of the dielectric barrier discharge lamp of this invention.

The mode of implementation of the dielectric barrier discharge lamp of this invention is explained below. FIG. 1 shows the structure of one example of a dielectric barrier discharge lamp in accordance with this invention. This dielectric barrier discharge lamp has a sealed discharge chamber 10 with a two-layer structure comprising a cylindrical outer tube 1 made of dielectric, and a cylindrical inner tube 12 made of dielectric that is concentric with the outer tube 11 and has an outside diameter smaller than the inside diameter of the outer tube 11. In this discharge chamber 10, the ends of the outer tube 11 and the inner tube 12 are connected by end walls 13, 14, thus forming a toroidal discharge space S, between the outer tube 11 and the inner tube 12, which is filled with a discharge gas.

The dielectric material that makes up the discharge chamber 10 can be one that is transparent to the excimer light emitted from the discharge chamber 10, such as synthetic quartz glass. The discharge gas sealed in the discharge chamber 10 can be one that emits excimer light with a wavelength of 200 nm or less, such as xenon gas or a mixture of argon and chlorine.

There is one electrode 21, perhaps a mesh of metal or other electroconductive material, in close contact with the outer surface 15 of the outer tube 11 of the discharge chamber 10, as well as another electrode 22, perhaps a sheet of aluminum, in close contact with the inner surface 16 of the inner tube 12. This other electrode 22 can be made up of two semi-cylindrical aluminum sheets, pressed by a suitable pressure piece against the inner surface 16. The electrode 21 and the electrode 22 are connected to a high frequency power supply 23. Two fluid distribution tube remnants 25, 26 are formed on the end walls 13, 14 at the ends of the discharge chamber 10, and so that the fluid distribution tube remnants 25, 26 are separated in the axial direction.

Figure 2:
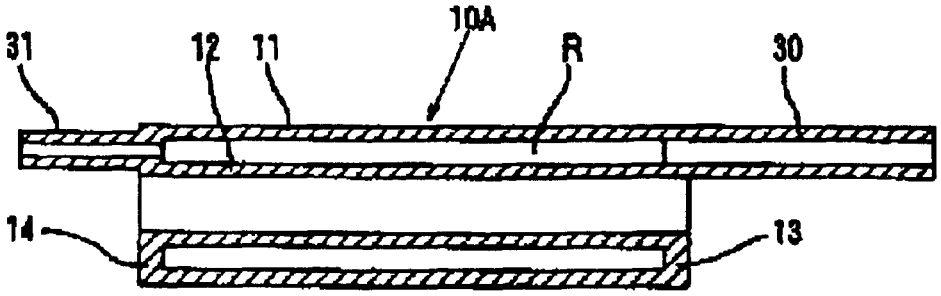
FIG. 2 is a sectional view showing one example of the structure of the chamber material to form the discharge chamber in the dielectric barrier discharge lamp shown in FIG. 1.
Figure 7:
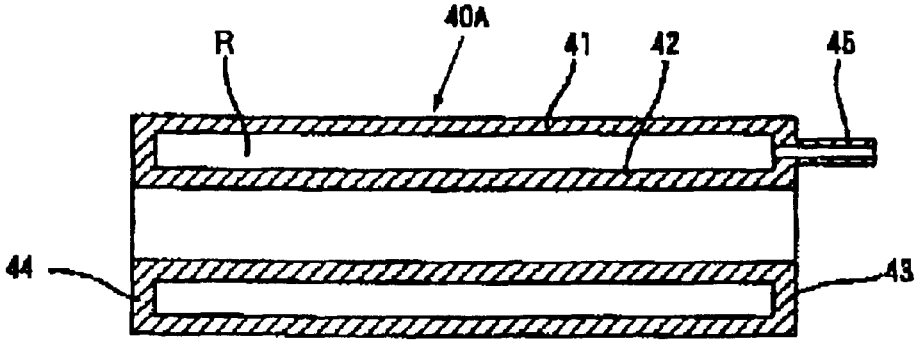
FIG. 7 (Prior Art)
FIG. 7 is a sectional view showing an example of the structure of the chamber material to form the discharge chamber in a conventional dielectric barrier discharge lamp.
Figure 8:
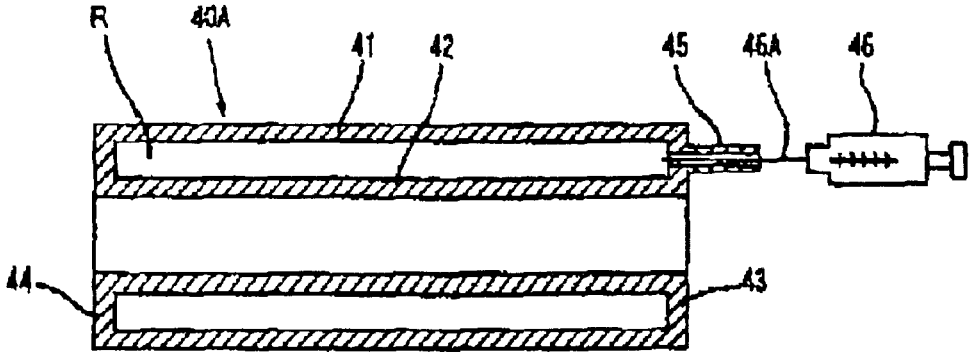
FIG. 8 (Prior Art)
FIG. 8 is a sectional view showing an example of the method of injecting cleaning agent into the chamber material shown in FIG. 7.
Figure 9:
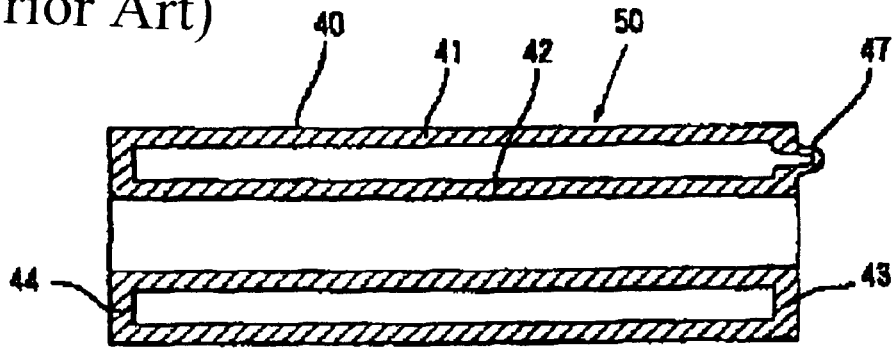
FIG. 9 (Prior Art)
FIG. 9 is a sectional view showing the lamp proper resulting from the known sealing process.

The dielectric barrier discharge lamp described above is manufactured as follows. FIG. 2 shows the chamber material 10A used in the manufacture of the dielectric barrier discharge lamp of FIG. 1. This chamber material 10A has the same basic structure as the chamber material 40A shown in FIG. 7; there is a first fluid distribution tube 30 on one end wall 13, and a second fluid distribution tube 31 on the opposite end wall 14, both of which are connected through to the internal space R. The first fluid distribution tube 30 and the second fluid distribution tube 31 have different tube diameters, the diameter of the first fluid distribution tube 30 being greater than that of the second fluid distribution tube 31.

Figure 3:
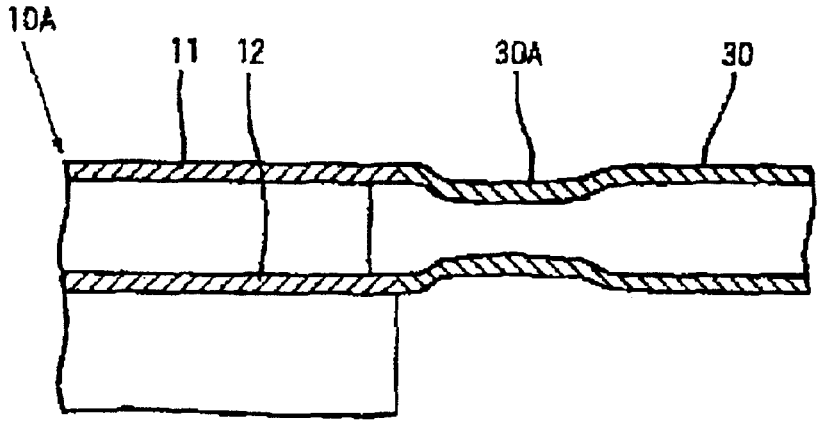
FIG. 3 is a sectional view showing the detail of a connection between the first fluid distribution tube and an end wall of the chamber material shown in FIG. 2.

FIG. 3 is an explanatory cross-section showing an expanded portion of the connection between the first fluid distribution tube 30 and the end wall 13 of the chamber material 10A shown in FIG. 2. A reduced-diameter portion 30A of the first fluid distribution tube 30 is formed close to the point of its juncture with one end wall 13. This reduced-diameter portion 30A is formed by heating with a burner, for example, and in a fluid distribution tube with an outer diameter of 8.0 mm and an inner diameter of 6.0 mm, the reduced-diameter portion 30A would have an outer diameter of 5.0 mm and an inner diameter of 3.0 mm. A similar reduced-diameter portion (not illustrated) is formed in the second fluid distribution tube 31.

Figure 4:
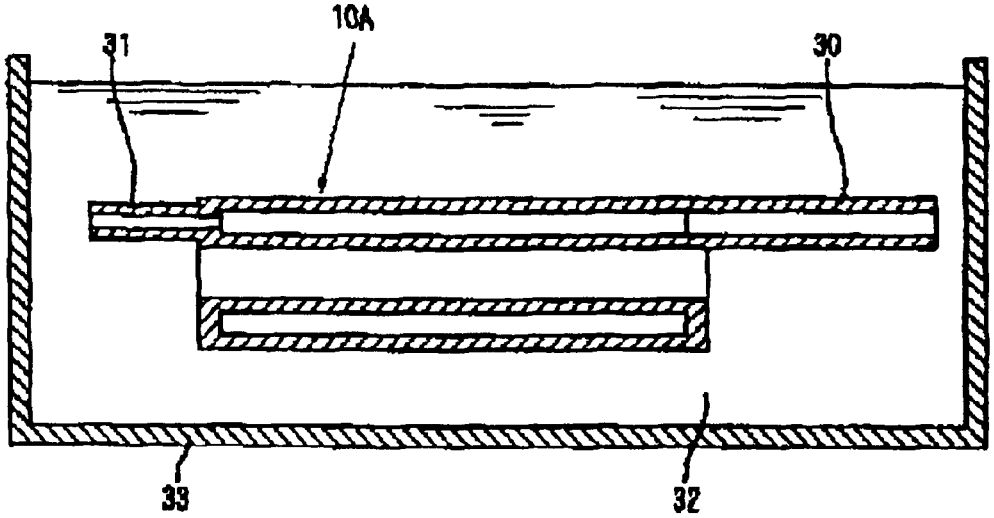
FIG. 4 is an explanatory drawing showing an example of the method of injecting cleaning agent into the chamber material shown in FIG. 3.

Such a chamber material 10A first undergoes the cleaning process. In the cleaning process a cleaning fluid of suitable concentration, such as 9 wt-% ammonium fluoride, is used for the reagent cleaning treatment, and cleaning water is used for the rinse treatment. In the reagent cleaning treatment, the chamber material 10A is gradually placed into a reagent bath 33 filled with a reagent 32, with the chamber material 10A held at an angle with the first fluid distribution tube 30 downward. Then, as the clean reagent flows into the chamber material 10A through the first fluid distribution tube 30, the air inside the chamber material 10A escapes through the second fluid distribution tube 31, and so the cleaning reagent 32 fills the chamber material 10A quite easily. The chamber material 10A is left to soak in the reagent, as shown in FIG. 4, for perhaps 30 minutes, after which it is removed from the reagent bath 33. By removing the chamber material 10A at an angle with the first fluid distribution tube 30 directed downward, the cleaning reagent 32 runs out through the first fluid distribution tube 30, and at the same time, air flows into the chamber material 10A through the second fluid distribution tube 31. Thus, the cleaning reagent 32 is removed from the discharge chamber 10 quite easily.

Afterwards the chamber material 10A is submerged in a bath filled with cleaning water by the same procedure used during the reagent cleaning treatment. After the inside of the chamber material 10A has been rinsed, the chamber material 10A is removed from the cleaning bath to complete the rinse treatment. This rinse treatment with cleaning water is preferable repeated, perhaps three times.

Following completion of the cleaning process, the chamber material 10A is put through a drying treatment. In the drying treatment, the chamber material 10A is placed with the first fluid distribution tube 30 upward in an electric furnace with its temperature set at 80° C., for example, and dried for about 1 hour.

Figure 5:
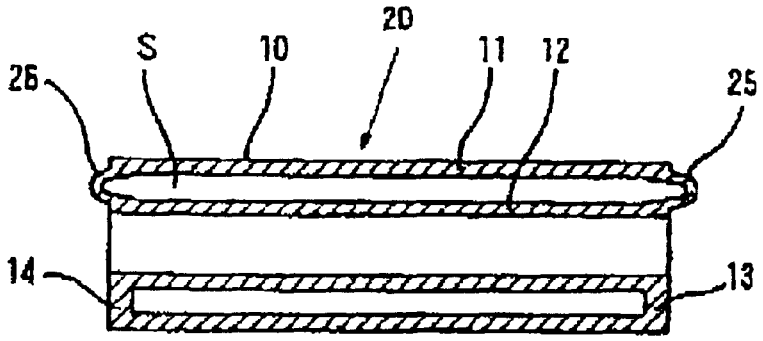
FIG. 5 is a sectional view showing the lamp proper resulting from the sealing process.

Next, the chamber material 10A goes through the sealing process. In this sealing process, the reduced diameter portion of the smaller-diameter second fluid distribution tube 31 is heated with a burner. By this means, the reduced diameter portion is burned through, and a dome-shaped fluid distribution tube remnant 26 is produced. Then, after the second fluid distribution tube 31 is sealed, an exhaust device is connected to the first fluid distribution tube 30, by which means the air is exhausted from the internal space R, after which the internal space R is filled with a discharge gas such as xenon. After that, the reduced diameter portion of the first fluid distribution tube 30 is burned through with a burner, and a dome-shaped fluid distribution tube remnant 25 is formed. As a result, the internal space R is sealed, and a lamp proper 20 having a discharge chamber 10 sealed full of discharge gas is formed with two fluid distribution tube remnants 25, 26 formed on one end and on the other end, as shown in FIG. 5.

Then, an electrode 21 is applied to the outer surface of the outer tube 11 of the lamp proper 20, and another electrode 22 is applied to the inner surface of the inner tube 12, thus producing a dielectric barrier discharge lamp with the constitution shown in FIG. 1.

The following is an example of the measurements of the chamber material of the dielectric barrier discharge lamp of this invention described above. The outer tube (11) of the chamber material (10A) is 300 mm long, 26.5 mm outside diameter, 24.5 mm inside diameter, 2.0 mm wall thickness. The inner tube (12) is 300 mm long, 16 mm outside diameter, 14 mm inside diameter, 2.0 mm wall thickness. The capacity of the internal space (R) is 80 $cm^3$. The first fluid distribution tube (30) is 150 mm long, 8.0 mm outside diameter, 6.0 mm inside diameter, 2.0 mm wall thickness. The second fluid distribution tube (31) is 100 mm long, 6.0 mm outside diameter, 4.0 mm inside diameter, 2.0 mm wall thickness.

The dielectric barrier discharge lamp above is made with two fluid distribution tube remnants 25, 26 formed one on each end of the discharge chamber 10, and accordingly, the two fluid distribution tube remnants 25, 26 are separated from each other along the tube axis of the discharge chamber 10. Consequently, in the manufacture of the discharge chamber 10, by using a chamber material 10A with two fluid distribution tubes 30, 31 in positions separated from each other along the tube axis, it is possible to use at least one fluid distribution tube as a route for ingress and egress of cleaning fluid, and also to assure that the other fluid distribution tube is available as a route for the flow of air within the chamber material. Thus, the operations of filling the chamber material with cleaning fluid and emptying it again can be carried out quite smoothly and with adequately high efficiency.

Moreover, in the drying operation for the chamber material 10A, the water vapor flows out the first fluid distribution tube 30 which is positioned upward, and so air circulates smoothly in the chamber material 10A, and the chamber material 10A can be dried efficiently as a result. Because of that the manufacture of the dielectric barrier discharge lamp of this invention is easier and the manufacturing time required can be shortened considerably.

Moreover the process of injecting cleaning fluid into the chamber material and the removal process can be carried out reliably, and so it is possible to reliably wash and remove dirt and foreign bodies from the inside surface of the chamber material 10A. As a result, it is possible to prevent the occurrence of reduced light intensity or lighting flaws caused by dirt or foreign bodies inside the chamber material 10A, and so it is possible to obtain good lighting characteristics.

The mode of implementation of this invention has been explained above, but the dielectric barrier discharge lamp of this invention is not limited to the mode of implementation described above; it is possible to make a variety of changes. For example, there is no particular limit on the number of fluid distribution tubes attached to the chamber material, nor to their diameter or location.

Figure 6:
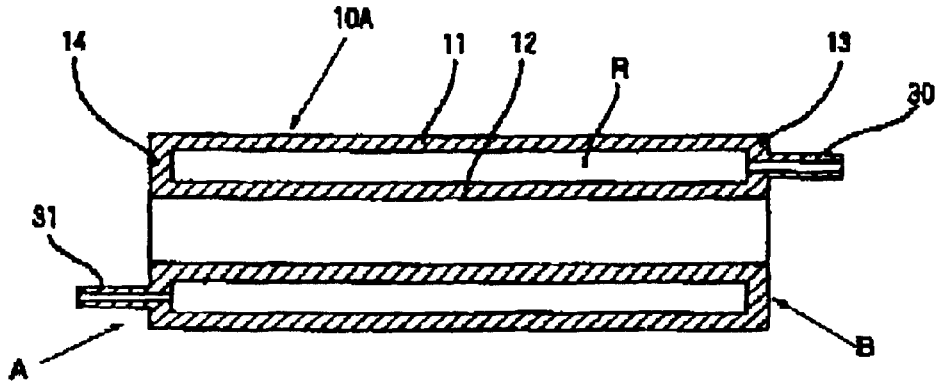
FIG. 6 is a sectional view of the chamber material showing an example of connection of the fluid distribution tubes.

Specifically, it is preferable that the fluid distribution tubes be attached in positions that are somewhat separated from each other. If, when the first fluid distribution tube 30 is attached to the upper part of the end wall 13, as shown in FIG. 6, it is best if the position of the second fluid distribution tube 31 is at position A, separated from the second fluid distribution tube 31 in the axial direction of the chamber material 10A, and separated from the first fluid distribution tube 30 in the radial direction. Alternatively, it can be in position B, on the same end wall 13 but radially separated with the inner tube 12 sandwiched between the two fluid distribution tubes. It is also possible to attach the fluid distribution tubes to the outer tube 11 or the inner tube 12 rather than to the end walls 13, 14 of the chamber material 10A.

In the explanation above, the number of fluid distribution tubes attached to the chamber material is two, but the following explanation will deal with the case of chamber material with three fluid distribution tubes or four fluid distribution tubes attached. In the event that three fluid distribution tubes are attached to the chamber material, then for example, the first fluid distribution tube 30 would be attached to one end wall, the second fluid distribution tube would be attached to the other end wall, and the third fluid distribution tube would be attached to the outer tube. In that case, it is preferable that the third fluid distribution tube be attached in a position near to an end wall.

In the event that four fluid distribution tubes are attached to the chamber material, then for example, the first fluid distribution tube 30 would be attached to one end wall, the second fluid distribution tube would be attached to the other end wall, the third fluid distribution tube would be attached to the outer tube, and the fourth fluid distribution tube would be attached to the inner tube. In that case, it is preferable that the third fluid distribution tube and the fourth fluid distribution tube be attached in positions near to end walls.

With the constitutions described above, the operations of moving the cleaning fluids into and out of the chamber material will be highly efficient.

As a means of moving the cleaning fluid into the chamber material, it is possible to connect a connecting tube to any of the fluid distribution tubes, and inject the cleaning fluid through that connecting tube. The effect described above will be achieved in that event, since when the cleaning fluid is injected into the chamber material through the first fluid distribution tube, the air within the chamber material will escape through the second fluid distribution tube.

EFFECT OF INVENTION

In the manufacture of the dielectric barrier discharge lamp of this invention, two or more fluid distribution tubes are attached to the chamber material that makes up the discharge chamber, and so when one or more of the fluid distribution tubes are being used to move cleaning fluids into or out of the chamber material, the other fluid distribution tube or tubes can be kept as a route for air to move out of or into the chamber material. Therefore, the operation of moving cleaning fluids into or out of the chamber material can be performed easily and reliably. Consequently, it is possible to reliably clean and remove dirt and foreign objects from within the chamber material, and it is thus possible to prevent reduced lighting intensity or lighting flaws caused by dirt or foreign objects on the inner surface of the chamber material, so that it is possible to attain good lighting characteristics.

What is claimed is:

1. A dielectric barrier discharge lamp having a discharge chamber with a cylindrical, double-tube construction comprising an outer tube and an inner tube, in which a cylindrical discharge space formed between the outer tube and the inner tube is filled with a discharge gas in which excimer molecules are formed by a dielectric barrier discharge; wherein the discharge chamber is formed with remnants of two or more fluid distribution tubes that connect to the discharge space of the discharge chamber.

2. A dielectric barrier discharge lamp as described in claim 1, wherein the two or more fluid distribution tube remnants are formed on opposite ends of the discharge chamber.

* * * * *